United States Patent [19]

Lorenz

[11] 4,391,091

[45] Jul. 5, 1983

[54] FALSE TWISTING APPARATUS AND METHOD

[75] Inventor: Hellmut Lorenz, Remscheid-Lennep, Fed. Rep. of Germany

[73] Assignee: Barmag Barmer Maschinenfabrik AG, Remscheid, Fed. Rep. of Germany

[21] Appl. No.: 273,196

[22] Filed: Jun. 12, 1981

[30] Foreign Application Priority Data

Mar. 17, 1981 [DE] Fed. Rep. of Germany ..... 3110242
May 9, 1981 [DE] Fed. Rep. of Germany ..... 3118410

[51] Int. Cl.[3] ..... D02G 1/08

[52] U.S. Cl. ..... 57/340; 57/339; 57/348

[58] Field of Search ..... 57/334–340, 57/348, 349, 104, 105

[56] References Cited

U.S. PATENT DOCUMENTS

| | | | |
|---|---|---|---|
| 2,863,280 | 12/1958 | Ubbelohde | 57/336 X |
| 3,156,084 | 11/1964 | Van Dijk et al. | 57/340 |
| 3,225,533 | 12/1965 | Henshaw | 57/340 X |
| 3,373,554 | 3/1968 | Raschle | 57/340 |
| 3,394,540 | 7/1968 | Bentov | 57/337 X |
| 3,488,941 | 1/1970 | Asaka | 57/340 X |
| 3,495,391 | 2/1970 | Njo | 57/340 |
| 4,047,374 | 9/1977 | Venot | 57/338 |
| 4,050,229 | 9/1977 | Hayahusa | 57/340 X |
| 4,145,871 | 3/1979 | Iwata et al. | 57/340 |
| 4,149,366 | 4/1979 | Bass et al. | 57/339 X |
| 4,240,248 | 12/1980 | Raschle | 57/338 |
| 4,339,915 | 7/1982 | Dammann et al. | 57/339 |

FOREIGN PATENT DOCUMENTS

| | | |
|---|---|---|
| 2001120 | 7/1971 | Fed. Rep. of Germany . |
| 2121917 | 8/1971 | France . |
| 1375380 | 11/1974 | United Kingdom . |
| 1421662 | 1/1976 | United Kingdom . |

*Primary Examiner*—John Petrakes
*Attorney, Agent, or Firm*—Bell, Seltzer, Park & Gibson

[57] ABSTRACT

A yarn false twisting apparatus and method is provided which permits ready conversation from S to Z twist, or vice versa. The apparatus comprises a pair of friction discs which are rotatably mounted on a common carrier plate, and the discs are rotated in opposite directions by a drive system which includes a whorl mounted to each supporting shaft, and an endless drive belt having a run which engages opposite sides of the two whorls. The carrier plate is designed to permit the respective positions of the two discs to be reversed, and the direction of rotation of each disc to be reversed, to thereby convert from S to Z twist, or vice versa. In other embodiments, conversion between S and Z twist may be effected by the axial displacement of the two discs, or by the use of the two pressure applying members which define two separate twisting zones and which are alternately actuated.

20 Claims, 8 Drawing Figures

FALSE TWISTING APPARATUS AND METHOD

The present application relates to an improved yarn false twisting apparatus and method, of the type disclosed in commonly owned copending application Ser. No. 168,734, filed July 14, 1980, now U.S. Pat. No. 4,339,915.

A friction false twist apparatus is disclosed in the above referenced application which is composed of two rotatingly driven surfaces, which essentially contact each other in the plane of the threadline and nip the yarn to be false twisted therebetween. One of the surfaces is in the form of a rotating, relatively flexible disc, which can absorb relatively high tension forces, but only very small lateral bending forces. For the purpose of nipping the yarn, a pressure applying member is provided at the back side of this flexible disc, which member operatively engages the back side of the flexible disc only in the area where it is desired to nip the yarn, and which locally upsets the flexible disc from its plane normal to the axis of rotation. Therefore, both discs contact and nip the yarn locally in a vary narrowly limited area essentially defined by the pressure applying member. According to the above application, the other surface may also be in the form of a flexible disc with a pressure applying mechanism. However, it is also possible that the other surface is hard, i.e., a rigid disc or roll.

A friction false twist apparatus of the described type has also been proposed, in which one or both discs are rigid, or have at least a friction surface consisting of a rigid material, and in which one of the discs can be easily moved relative to its drive shaft, e.g., by means of a gimbal-like mounting, note German utility patent application No. Gbm 80 16 896; German patent application No. OS 31 04 788. A particular advantage of this type of friction false twist apparatus resides in the fact that it not only imparts a twist to the yarn, but also it exerts a conveyance effect on it.

It is an object of the present invention to provide a frictional false twist apparatus according to the above referenced U.S. application, which is so designed and constructed that, with a minimum amount of technical and constructional details, it is able to effect a change of the twist in the yarn from S to Z or vice versa, and wherein the ratio of twist and conveyance is variable, i.e., the angle of twist can be adjusted.

For these purposes, the present invention provides that both discs are mounted on a common carrier plate, with their axes aligned essentially horizontally and perpendicularly to the machine front, and with the journaled end of each drive shaft mounting a whorl. The whorl of one disc rests on the top of one run of a tangential drive belt which revolves in a horizontal plane along the false twist crimping machine, and the whorl of the other disc rests on the bottom of such run.

The drive of each of the two discs, and which jointly form the friction false twist apparatus, is thus provided by a whorl resting against a revolving tangential drive belt, which permits a very simple, rugged and, therefore, also a cost-saving construction of the false twist crimping machine, and the individual assemblies.

In a preferred embodiment of the friction false twist apparatus, the carrier plate is adapted to pivot about an axis located in the center between the bearings of the drive shafts for the discs, and the plate is biased by the action of a supply of force, such as a helical spring or the like, against the tangential belt, and so that both whorls rest against the belt essentially without slip. This supply of force produces a sufficient normal force, so that an essentially slipless operation of the false twist apparatus at each twisting station on the machine can be accomplished.

In order to change the twist in the yarn from S to Z, or vice versa, it is provided that the carrier plate may be reversed by 180 degrees about a pivotal axis disposed parallel to and intermediate the two axes of rotation, and in such a manner that the position of the discs is interchanged. For this purpose, it is preferable that the carrier plate including the discs, drive shafts and whorls mounted on it, is shifted in the axial direction or removed, and then re-attached in a position reversed by 180 degrees. This insures that the whorl which originally rested on top of the horizontally revolving tangential drive belt, thereafter rests against it from the bottom, and vice versa. The pressure applying member is also rearranged so that the point of contact with the yarn with regard to the threadline remains intact.

An alternative for changing the twist from S to Z may be provided in that the individual discs with their drive shafts, whorls and bearings are removably mounted on the carrier plate, and are so arranged on the plate and with regard to the tangential belt, that the discs can be interchanged. Here, suitable use is made of simply adjustable and easily operable locking mechanisms, such as toggles, cams, detachable arresters or similarly known means of attachment.

When, as is preferred, a disc is flexible and laterally upsettable, and is provided with a pressure applying member acting upon its back side, the pressure applying member may be also attached to the carrier plate, so as to be movable along a line midway between the two axes of rotation and in such a manner that it can always be positioned in the area of the yarn entry. However, to further simplify the construction of the apparatus, the mounting of the pressure applying member may be separate from the carrier plate, in this case on the machine frame, in the area of the yarn entry to the friction false twist apparatus. The advantage of this latter construction resides in that, when the twist is changed from S to Z, the pressure applying member remains in its position. Also, the path of displacement of the pressure applying member for adjusting twist and conveyance effects of the friction false twist apparatus can be shortened.

It has been found that the arrangement of yarn guides before and/or after the twist point is important for a good and constant twist result. For this reason, it is preferred that, such yarn guides are attached to the carrier plate so as to be located upstream and downstream of the twist point.

For the purpose of changing the twist from S to Z in a friction false twist apparatus, it may alternatively be provided that the position of the discs is axially adjustable, so that the axial spacing of the rotational planes of the discs from each other may be changed. By this arrangement, the discs can be interchanged in their position relative to the threadline. As will be apparent, a prerequisite for this is that each disc has a suitable friction coating on both of its surfaces. If one disc is flexible and pressed against the other disc by a pressure applying member acting on its back side, such member would also need to be rearranged when changing the friction false twist apparatus from S to Z twist with the described axial displacement of the discs.

It is preferred that both discs of the friction false twist apparatus be flexible, and pressed against each other by a pressure applying member acting on the back side of each disc. The pressure applying members are aligned essentially parallel to the drive shafts of the discs and disposed along a line which perpendicularly bisects a line segment connecting the two bearings. Here, when the twist is changed from S to Z, it is only necessary to interchange the two discs in their position relative to the threadline. Where the discs are flexible, they may be mounted on their drive shafts in the same normal plane, and such that they may be brought to the required position relative to the threadline by flexing the discs accordingly.

For the simplified production of novelty yarn, a slightly modified friction false twist apparatus may be provided, which has a pressure applying member positioned both above and below the plane extending between the drive shafts. The members are alternately engaged with the friction surface or the back side of the disc, so as to produce novelty yarn which contains alternating portions of S and Z twist.

Some of the objects and advantages of the invention having been stated, others will appear as the description proceeds, when taken in connection with the accompanying drawings in which.

Figure 1:
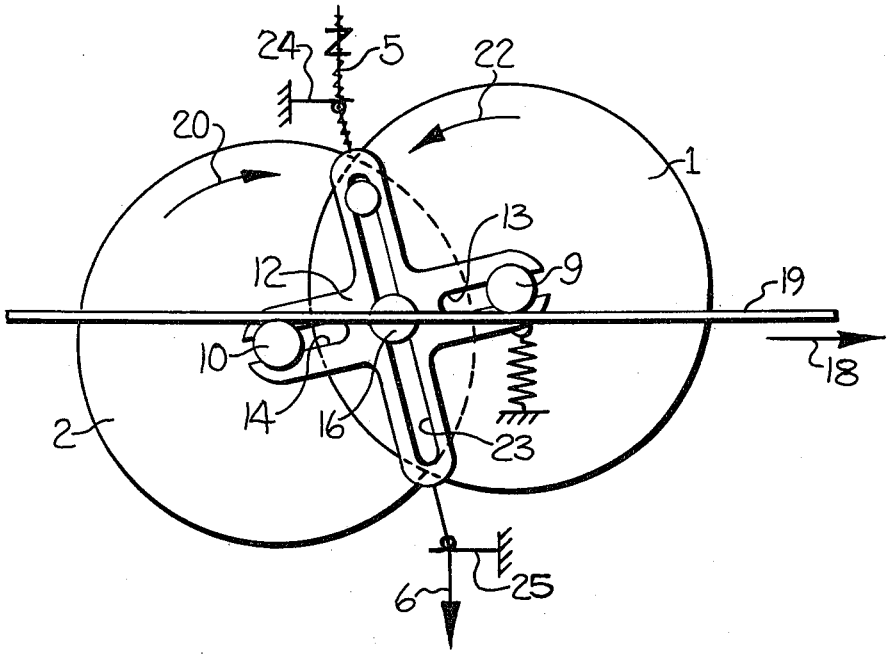
FIG. 1 is a schematic front elevation view of a false twisting apparatus embodying the features of the present invention.

Referring more particularly to the drawings, FIG. 1 shows a friction false twist apparatus according to the invention, and which comprises two discs 1 and 2, of which the disc 1 is made of a flexible material, which can absorb high tensional forces. Disc 1 is locally bulged or upset at 4 by, for example, a fluid-dynamically operating pressure applying member 3, and is pressed with the friction surface on its front side against the circumference of the other disc 2. Further details of the pressure applying member may be obtained from the above referenced copending application No. 168,734. Disc 2 may also consist of a flexible material and be locally pressed against disc 1. However, in the present illustrated embodiment, the disc 2 is a rigid or bending-resistant disc and has on its front face a friction coating 2.1 with similar frictional properties to those of disc 1.

Yarn 5 is nipped between bulge 4 of disc 1 and the friction surface of disc 2 in such a manner that it is conveyed in direction of arrow 6 by the action of force components, and it receives a twist in Z direction, as further described below.

Discs 1 and 2 are mounted on drive shafts 7, 8 which carry drive whorls 9, 10 on their journalled ends. Drive shafts 7, 8 are mounted in standard antifriction bearings 11 on a carrier plate 12. The bearing housings can be adjusted in guideway slots 13 and 14 in accordance with the desired twisting conditions, and firmly secured or locked in carrier plate 12 with the use of mounting means as indicated at 15.

The carrier plate 12 for mounting the false twist discs 1, 2 is attached to the machine frame of the false twist crimping machine (not shown in detail), in such a manner that the plate is placed on a horizontal pivotal pin 16 projecting from the machine, and secured against an undesired axial displacement by a snap or clip lock or the like. Carrier plate 12 can be pivoted about pin 16 in a plane parallel to the machine front. At least one supply of resilient force, such as a tension or compression spring 17, which is supported by in the machine frame, pulls or pushes carrier plate 12 with false twist discs 1, 2 mounted thereon, against endless tangential belt 19 running in a horizontal plane of the machine in direction of arrow 18. This is done in such a manner that the whorls 9, 10 at the ends of drive shafts 7, 8 firmly rest against tangential belt 19 and are driven essentially without slip. As is shown in FIG. 1, whorl 9 contacts the illustrated run of the tangential belt 19 from the top, and whorl 10 from the bottom, so that friction discs 1, 2 rotate in direction of arrows 20 and 22 and impart a Z twist to yarn 5 being fed from the top, which backs up in yarn 5 starting at the twist point.

Figure 2:
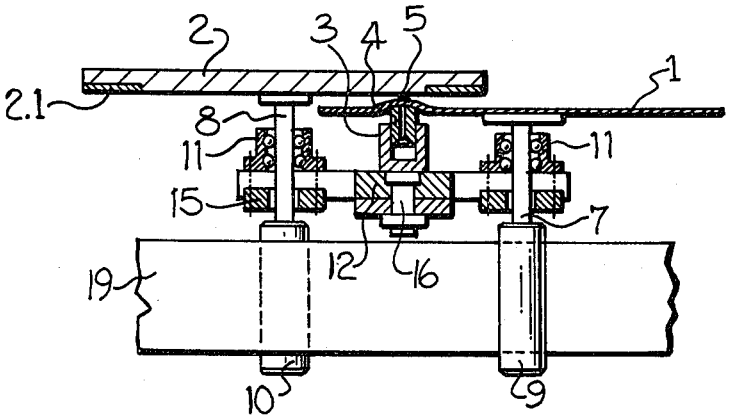
FIG. 2 is a sectional top plan view of the apparatus of FIG. 1.

The pressure applying member 3, which can be best seen in FIG. 2, can be shifted along a guideway slot 23 and secured on carrier plate 12, once it has been adjusted in the desired operating position. Hereby, it is possible to adapt the ratio of twist impartation and yarn conveyance to a suitable or required operating condition.

Figure 3:
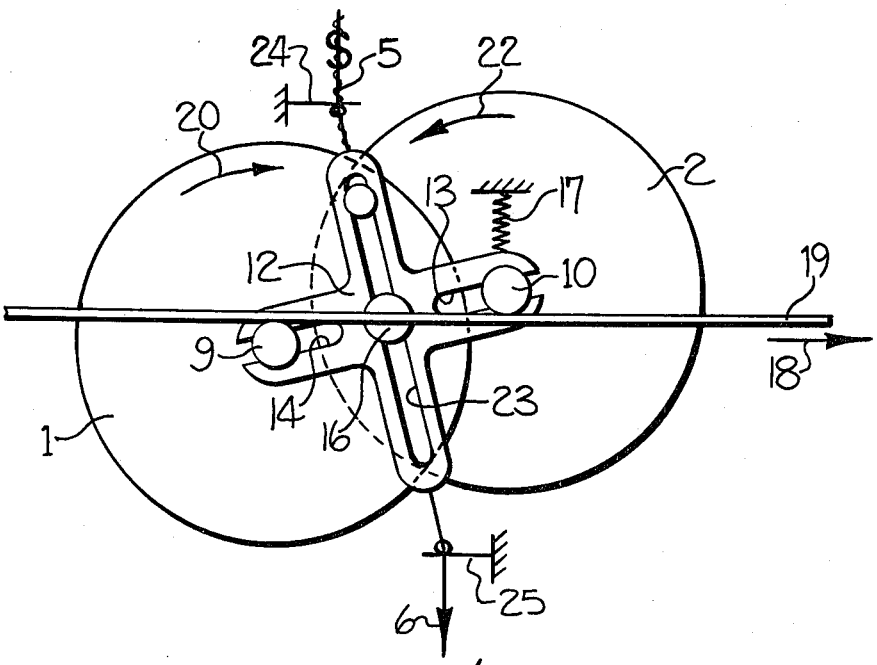
FIG. 3 is a schematic front elevation view of a different configuration of the apparatus.
Figure 4:
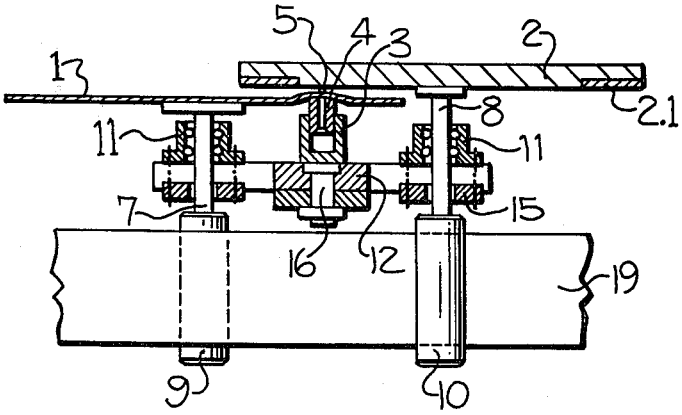
FIG. 4 is a sectional top plan view of the apparatus of FIG. 3.
Figure 5:
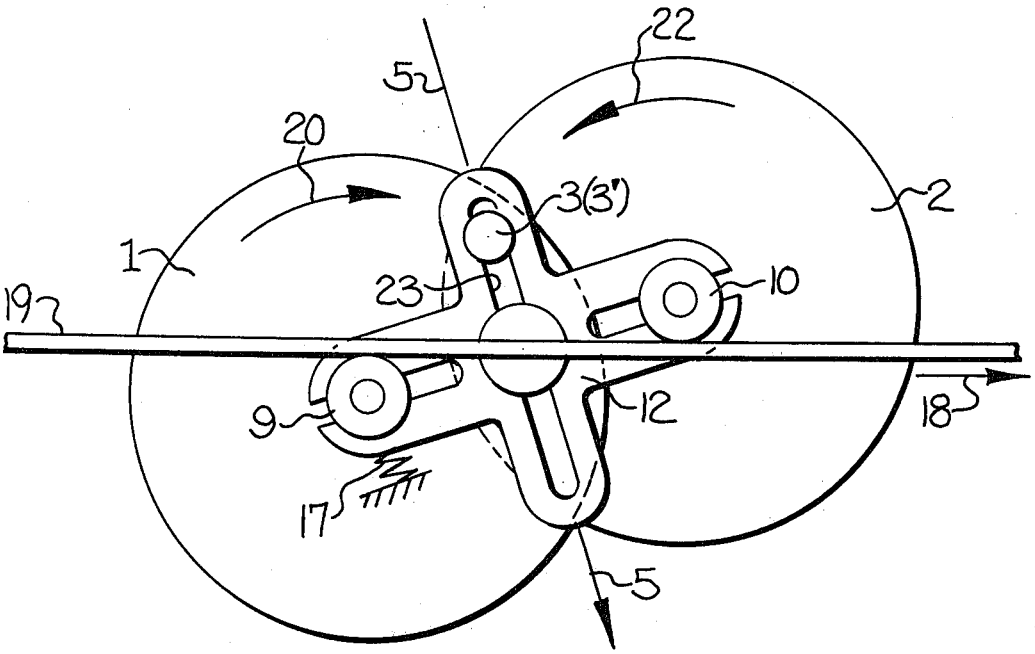
FIG. 5 is a schematic front elevation view of a different embodiment of the invention.

For the purpose of changing the friction false twist apparatus from S to Z twist, or vice versa, the invention provides that the locking means 15 of the antifriction bearing housings on carrier plate 12 may be loosened, and that both friction false twist discs 1, 2 including drive shafts 7, 8, whorls 9, 10 and bearings 11, may be laterally removed from the guideway slots 13, 14 in carrier plate 12. They may then be placed back in reversed order, readjusted and secured again in an operative position. Upon completion, as is shown in FIGS. 3 and 4, whorl 9 of disc 1 now contacts the run of tangential belt 19 from the bottom so that the disc rotates in the opposite direction. The same applies to disc 2, whose whorl 10 is now biased against the top of the tangential belt 19. Entering yarn 5 is now twisted in S direction (FIG. 3). It is not necessary to change the position of pressure applying mechanism 3, since carrier plate 12 and guide slots 13, 14 and 23 in carrier plate 12 are of a symmetrical design.

Alternatively, the entire carrier plate 12 on pin 16 can be axially withdrawn such that whorls 9, 10 can be pivoted past tangential belt 19. After having been turned by approximately 180 degrees, the assembly is axially pushed back so that the whorls again contact the tangential belt, with the supply of force 17 becoming again operative on carrier plate 12. In this case, it is additionally required that the pressure applying member be mounted on the other side of the pin on the carrier plate.

Figure 6:
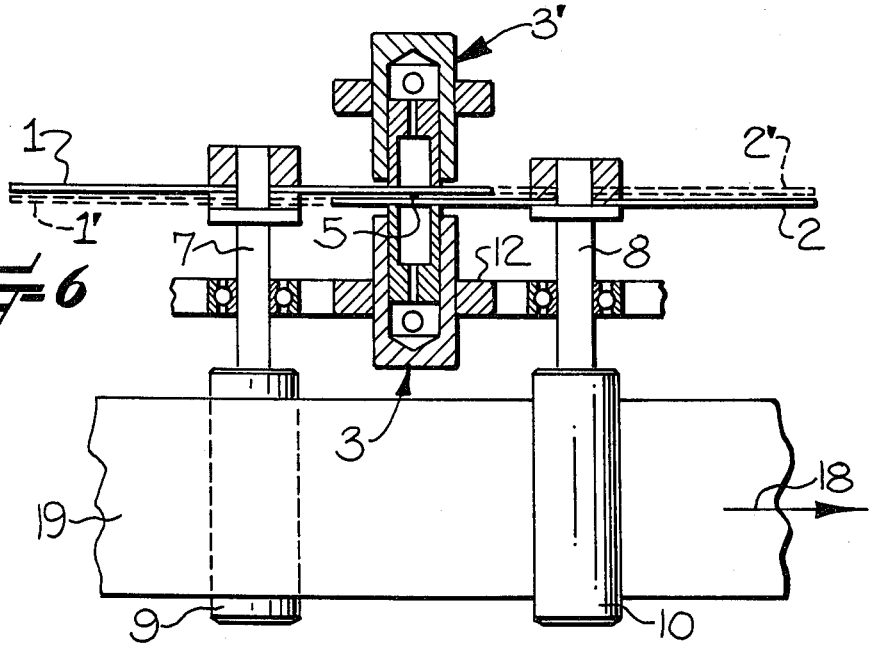
FIG. 6 is a sectional top plan view of the apparatus of FIG. 5.

Finally, the twist may be changed from S to Z or vice versa by axially displacing friction discs 1, 2 on their drive shafts 7, 8 to the positions indicated by the discs 1' and 2' as shown in dashed lines in FIG. 6. In doing so, their position relative to the threadline is interchanged. This measure is preferred, when both friction discs 1, 2 are made of the same flexible material, and each of them is locally upset by an associated pressure applying member 3 in the area of the twist zone so as to nip the yarn 5 between the friction surfaces. In such an embodiment of the friction false twist apparatus, the two pressure applying members 3 or 3' are arranged in alignment, and they can be jointly shifted and adjusted along guideway slot 23 in carrier plate 12. It should be noted that guideway slot 23 and 3' extends along a line which perpendicularly bisects the connecting line between the two axes of rotation of discs 1, 2, or along a line parallel thereto.

It should be noted that the pressure applying member (or members) can be adjustably mounted on the machine frame, i.e., essentially separately from carrier plate 12. In such event, they retain their position when carrier plate 12 is pivoted, and it is not necessary to shift them along guideway slot 23 extending along the line between drive shafts 7, 8 of the false twist discs 1, 2, or to rearrange them.

Two yarn guides are indicated in the drawing at 24 and 25. These are also preferably attached to the carrier plate and located in the entry area of yarn 5 into the nipping apex of discs 1, 2. Upon the pivoting motion of carrier plate 12 by 180 degrees as described above, yarn guides 24, 25 are also symmetrically arranged.

Figure 8:
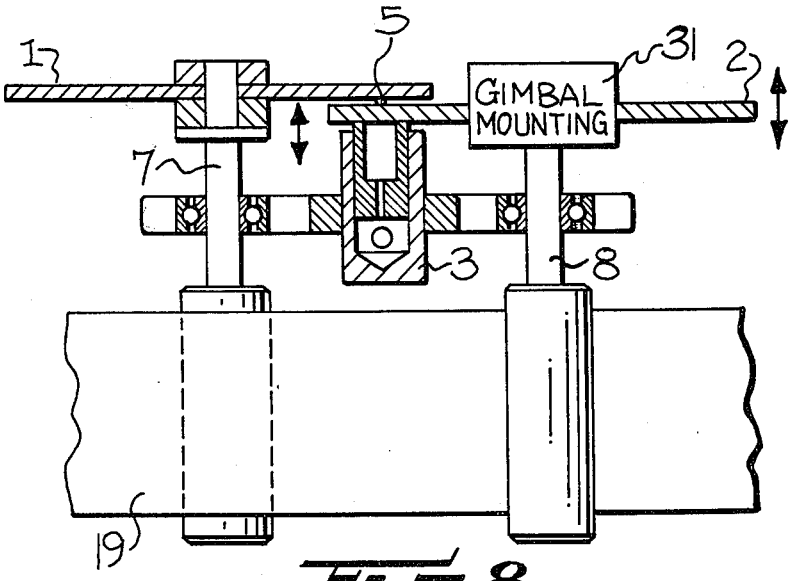
FIG. 8 is a sectional top plan view of still another embodiment of the invention.

The present invention can also advantageously be applied to friction false twist apparatus of the type described in German utility patent application No. Gbm 80 16 896 and German patent application No. OS 31 04 788, but not described here in detail. In those friction false twist apparatus, one of the two preferably rigid discs is slightly movable relative to its drive shaft, such as by means of a gimbal-like mounting as schematically illustrated at 31 in FIG. 8, and the disc may be deflected by a pressure applying member operating on the back side of the disc, and against the friction surface of the other rigid disc, to nip the yarn.

Figure 7:
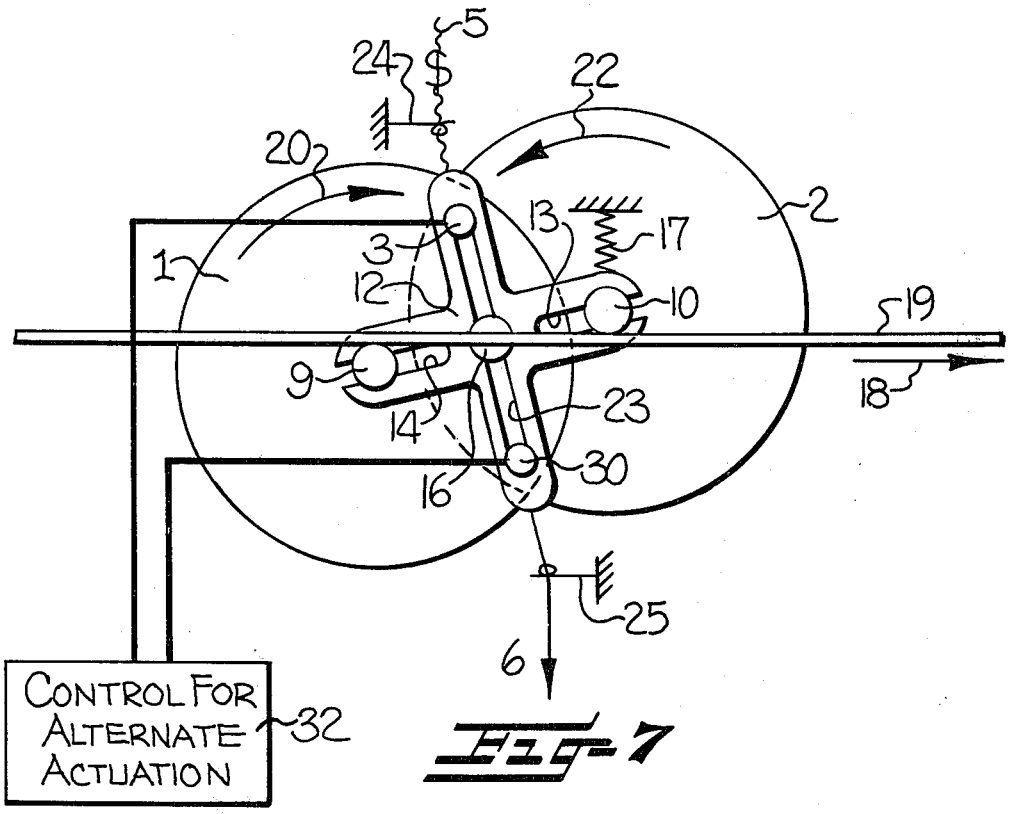
FIG. 7 is a schematic front elevation view of a further embodiment of the invention.

FIG. 7 schematically illustrates the above described embodiment for producing a novelty yarn, which includes two pressure applying members 3 and 30 positioned respectively above and below the plane extending between the drive shafts 7 and 8. Means indicated generally at 31 are provided for alternately actuating the two pressure applying members to produce alternating S and Z twist in the advancing yarn.

In the drawings and specification, there has been set forth preferred embodiments of the invention, and although specific terms are employed, they are used in a generic and descriptive sense only and not for purposes of limitation.

That which is claimed is:

1. A yarn false twisting apparatus comprising a frame, a pair of twist imparting discs, with each disc being mounted to a supporting shaft and having a yarn engaging friction surface on one face thereof, means mounting said discs to said frame and including a carrier plate mounting said shafts for rotation about essentially parallel, spaced apart axes and such that portions of the respective yarn engaging friction surfaces are disposed in opposing relationship and define a twisting zone therebetween;

drive means for rotating each of said discs in opposite rotational directions, said drive means including a whorl mounted to each of said shafts, and an endless drive belt rotatably mounted to said frame so as to have a run contacting opposite surfaces of said whorls and thereby rotate the same in opposite directions, whereby a yarn may be continuously moved through said twisting zone in a direction extending perpendicular to the plane defined by said axes of rotation and so as to have twist imparted thereto by frictional contact between the yarn and the respective opposed friction surfaces.

2. The yarn false twisting apparatus as defined in claim 1 wherein said carrier plate is mounted for pivotal movement about an axis disposed parallel to said axes of rotation and centrally therebetween, and further comprising means for resiliency biasing said carrier plate for pivotal movement about said axis in a direction to press each of said whorls against said drive belt.

3. The yarn false twisting apparatus as defined in claim 1 or 2 wherein said shafts are removably mounted to said carrier plate, and whereby the discs may be interchanged to convert from S to Z twist, or vice versa.

4. The yarn false twisting apparatus as defined in claim 1 or 2 wherein at least one of said discs is relatively thin and flexible, and said apparatus further comprises a pressure applying member, and means mounting said pressure applying member to said frame so as to locally bias said one flexible disc toward the other disc at said twisting zone.

5. The yarn false twisting apparatus as defined in claim 4 wherein said pressure applying member is adjustably mounted on said carrier plate by means permitting movement along a direction which extends perpendicular to the plane defined by the axes of rotation of said discs.

6. The yarn false twisting apparatus as defined in claim 5 wherein said shafts are mounted to said carrier plate by means permitting selective movement along a direction parallel to a line extending perpendicularly between said shafts.

7. The yarn false twisting apparatus as defined in claim 1 or 2 wherein said carrier plate is removably mounted to said frame, to permit the same to be removed from the frame and replaced in a position rotated about 180 degrees for its original position, to thereby convert from S to Z twist, or vice versa.

8. The yarn false twisting apparatus as defined in claim 1 or 2 wherein said shafts of said discs are mounted for selective axial movement with respect to said carrier plate, and such that each of said discs may be axially shifted to engage the side of the yarn opposite the side it formerly engaged, to thereby convert from S to Z twist, or vice versa.

9. The yarn false twisting apparatus as defined in claim 8 wherein both of said discs are relatively thin and flexible, and said apparatus further comprises a pair of pressure applying members, and means mounting said pressure applying members in alignment with said twisting zone, and with each member being positioned adjacent the side of one disc opposite the friction surface thereof and so as to bias the same toward the other disc at said twisting zone.

10. The yarn false twisting apparatus as defined in claim 1 or 2 wherein each of said discs is relatively rigid, and wherein at least one of said discs is mounted to its supporting shaft by gimbal-like interconnection means which permits such disc to freely incline with respect to the axis of the shaft.

11. The yarn false twisting apparatus as defined in claim 1 or 2 wherein at least one of said discs is relatively thin and flexible, and said apparatus further comprises a pair of pressure applying members, and means mounting one of said members on one side of the plane defined by the axes of rotation and at said twisting zone, and means mounting the other of said members on the other side of said plane to define a second twisting zone.

12. The yarn false twisting apparatus as defined in claim 11 further comprising means for alternately actuating said pair of pressure applying members to produce alternating S and Z twist in the advancing yarn.

13. A method of false twisting a yarn and converting from S to Z twist to vice versa, and comprising the steps of providing a pair of twist imparting circular discs, with each disc including a yarn engaging friction surface, and with said discs being rotatably mounted on a common carrier plate for rotation about parallel spaced apart axes and such that portions of the respective yarn engaging friction surfaces are disposed in opposing, face to face relationship, and define a twisting zone therebetween, rotating each of said discs in opposite directions about their respective axes, while advancing a yarn along a path of travel through said twisting zone in a direction perpendicular to a plane defined by the axes of rotation of said discs so as to have twist imparted thereto by frictional contact between the yarn and the respective opposed friction surfaces, and then reversing the respective positions of said discs and reversing the direction of rotation of each disc, while maintaining the same yarn path of travel and the same friction surfaces in contact with the yarn, to thereby convert from S to Z twist, or vice versa.

14. The method as defined in claim 13 wherein the step of reversing the respective positions of said discs includes interchanging the discs on said carrier plate.

15. The method as defined in claim 13 wherein the step of reversing the respective positions of said discs includes rotating said carrier plate through approximately 180 degrees about an axis disposed parallel to and intermediate said axes of rotation.

16. A method of false twisting a yarn and converting from S to Z twist or vice versa, and comprising the steps of providing a pair of twist imparting circular discs, with each disc including a yarn engaging friction surface, and with at least one of said discs being relatively thin and flexible, and with said discs being mounted for rotation about parallel spaced apart axes and such that portions of the respective yarn engaging friction surfaces are disposed in opposing, face to face relationship, providing at least one pressure applying member, with said pressure applying member being positioned intermediate said axes of rotation of said discs and so as to locally bias said one flexible disc toward the other disc and thereby define a twisting zone, rotating each of said discs in opposite directions about their respective axes, while advancing a yarn along a path of travel through said twisting zone in a direction perpendicular to a plane defined by the axes of rotation of said discs so as to have twist imparted thereto by frictional contact between the yarn and the respective opposed friction surfaces resulting from the force exerted by said pressure applying member, and then reversing the respective positions of said discs such that each axis of rotation is disposed on the opposite side of said pressure applying member from its original position, and reversing the direction of rotation of each disc, while maintaining the same friction surfaces in contact with the yarn and the same yarn path of travel, to thereby convert from S to Z twist, or vice versa.

17. A method of false twisting a yarn and converting from S to Z twist or vice versa, and comprising the steps of providing a pair of twist imparting circular discs, with each disc being relatively thin and flexible and including a yarn engaging friction surface on each side thereof, and with said discs being mounted for rotation about parallel spaced apart axes and such that portions of the respective yarn engaging friction surfaces are disposed in opposing, face to face relationship, providing a pair of pressure applying members, with said pressure applying members being aligned with each other and so as to locally bias respective ones of said flexible discs toward the other disc and thereby define a twisting zone, rotating each of said discs in opposite directions about their respective axes, while advancing a yarn along a path of travel through said twisting zone in a direction perpendicular to a plane defined by the axes of rotation of said discs so as to have twist imparted thereto by frictional contact between the yarn and the respective opposed friction surfaces resulting from the force exerted by said pressure applying member, and then moving each of said discs axially along its axis of rotation so that the opposite friction surface engages the opposite side of the yarn which such disc formerly engaged, while maintaining the same direction of rotation of each disc and yarn path of travel, to thereby convert from S to Z twist or vice versa.

18. A method of false twisting a yarn and alternately imparting S and Z twist to produce a novelty yarn, and comprising the steps of providing a pair of twist imparting circular discs, with each disc including a yarn engaging friction surface, and with at least one of said discs being relatively thin and flexible, and with said discs being mounted for rotation about parallel spaced apart axes and such that portions of the respective yarn engaging friction surfaces are disposed in opposing, face to face relationship, providing a first pressure applying member, with said first pressure applying member being positioned intermediate said axes of rotation of said discs and on one side of the plane defined by such axes of rotation, and so as to locally bias said on flexible disc toward the other disc and thereby define a first twisting zone, providing a second pressure applying member, with said second member being positioned intermediate said axes of rotation and on the other side of the plane defined by such axes, and so as to locally bias said one flexible disc toward the other disc and thereby define a second twisting zone, rotating each of said discs in opposite directions about their respective axes, while advancing a yarn along a path of travel through said twisting zone in a direction perpendicular to a plane defined by the axes of rotation of said discs so as to have twist imparted thereto by frictional contact between the yarn and the respective opposed friction surfaces resulting from the force exerted by one of said pressure applying members at the associated twisting zone, while alternately actuating said first and second pressure applying members to produce alternating S and Z twist portions in the advancing yarn.

19. A yarn twisting apparatus comprising a pair of twist imparting circular discs, with each disc including a yarn engaging friction surface, and at least one of said discs being flexible, means rotatably mounting said circular discs for rotation about respective spaced apart substantially parallel axes and such that portions of the respective yarn engaging friction surfaces are disposed in opposing, face to face relationship and define a first twisting zone therebetween which is located at a point laterally spaced on one side of the plane defined by the axes of rotation, and a second twisting zone therebetween which is located at a point laterally spaced on the other side of said plane, drive means for operatively rotating each of said circular discs in opposite directions about their respective axes, a pair of pressure applying members, with said members each being operatively positioned adjacent the face of said flexible disc opposite its yarn engaging friction surface, with one member aligned with said first twisting zone and the other member aligned with said second twisting zone, and adapted to bias said discs toward each other locally at each of said twisting zones and such that a yarn may be advanced through said twisting zones while having twist imparted thereto by frictional contact between the yarn and the respective opposed friction surfaces.

20. The yarn twisting apparatus as defined in claim 19 further including control means for selectively actuating said pair of pressure applying members to thereby permit the application of either S or Z twist in the advancing yarn.

* * * * *